US006884490B2

(12) United States Patent
Arai

(10) Patent No.: US 6,884,490 B2
(45) Date of Patent: Apr. 26, 2005

(54) DESIGNED TAPE

(75) Inventor: Shintaro Arai, 7-12, Aza Takamatsu-Mi Takamatsu-Machi, Kahoku-gun, Ishikawa (JP), 929-1215

(73) Assignees: Arai Weaving Ltd., Ishikawa (JP); Shintaro Arai, Ishikawa (JP)

( * ) Notice: Subject to any disclaimer, the term of this patent is extended or adjusted under 35 U.S.C. 154(b) by 52 days.

(21) Appl. No.: 10/414,999

(22) Filed: Apr. 16, 2003

(65) Prior Publication Data

US 2003/0207076 A1 Nov. 6, 2003

(30) Foreign Application Priority Data

Apr. 19, 2002 (JP) ..... 2002-117501

(51) Int. Cl.[7] ..... D04D 9/04

(52) U.S. Cl. ..... 428/102; 428/119; 112/417; 112/418

(58) Field of Search ..... 428/57, 102, 119; 112/441, 440, 429, 417, 418

(56) References Cited

U.S. PATENT DOCUMENTS

| | | | | |
|---|---|---|---|---|
| 507,836 A | | 10/1893 | Orndoff | |
| 1,905,685 A | | 4/1933 | Safir et al. | |
| 2,932,121 A | * | 4/1960 | Weitzel | 428/123 |
| 3,592,720 A | * | 7/1971 | Wattles et al. | 428/123 |
| 3,940,812 A | * | 3/1976 | Zapf | 112/418 |
| 3,970,116 A | | 7/1976 | Takada et al. | |

FOREIGN PATENT DOCUMENTS

| | | |
|---|---|---|
| FR | 2 155 743 A | 5/1973 |
| FR | 2 221 944 A | 10/1974 |
| GB | 758 533 A | 10/1956 |

* cited by examiner

*Primary Examiner*—Alexander S. Thomas
(74) *Attorney, Agent, or Firm*—Stevens & Showalter LLP

(57) ABSTRACT

A design tape provided with one or more round bar-like protrusions each having a circular cross-section and extending parallel with each other along a central line of a surface of plain weave cloth, each of the round bar-like protrusions being constructed by making use of hollow weave fabric and having a substantially circular cross-section. This design tape is characterized in that it is constituted by a couple of tape components arrayed side by side, that at least one of the tape components is provided at an edge portion of one of the selvages thereof with a round bar-like protrusion which is constructed by making use of hollow weave fabric, that the selvages of the couple of tape components are juxtaposed and connected with each other by making use of stitching thread which is applied to a boundary line between the protrusions and the selvages of tape components, and that the connected portion of the couple of tape components is unfolded back to a flattened state of the design tape where surfaces of the couple of tape components are made flush with each other.

1 Claim, 9 Drawing Sheets

DESIGNED TAPE

This application claims priority to Japanese Patent Application No. 2002-117501, filed Apr. 19, 2002.

TECHNICAL FIELD

The present invention relates to a design tape, and in particular, to a design tape formed of plain weave fabric as a base cloth and provided with a round bar-like protrusion having a circular cross-section and extending along a central line of the surface thereof, the round bar-like protrusion being constructed by making use of hollow weave fabric.

BACKGROUND OF THE INVENTION

As shown in FIGS. 7 and 8, there are known design tapes which are formed of plain weave fabric as a base cloth 2 and provided with a bar-like protrusion 4 extending along a central line of the surface thereof, the bar-like protrusion 4 being constructed by making use of hollow weave fabric. These conventional design tapes however are accompanied with drawbacks that the cross-section of the bar-like protrusion 4 thereof becomes semi-circular or elliptical in cross-section as shown in FIGS. 7 and 8. However, such a flattened structure of the bar-like protrusion 4 has been considered inevitable because of the reason that the bar-like protrusion is woven by making use of hollow weave fabric to be formed along a central line of the plain cloth.

As explained above, according to the conventional design tape, since the bar-like protrusion thereof becomes semi-circular or elliptical in cross-section, the bar-like protrusion simply looks collapsed in external appearance, thus scarcely contributing to the enhancement of commercial value of the design tape.

BRIEF SUMMARY OF THE INVENTION

The present invention has been made in view of overcoming the aforementioned drawback accompanied with the conventional design tape, and therefore, it is an object of the present invention to provide a design tape formed of plain weave fabric as a base cloth (hereinafter, it may be referred to simply as plain weave cloth) and provided with a round bar-like protrusion extending along a central line of the surface thereof, the round bar-like protrusion being constructed by making use of hollow weave fabric and substantially circular in cross-section.

With a view to attaining the aforementioned object, there is provided, as set forth in claim 1 of the present invention, a design tape provided with a couple of round bar-like protrusions each having a circular cross-section and extending parallel with each other along a central line of the surface of plain weave cloth, each of the round bar-like protrusions being constructed by making use of hollow weave fabric and substantially circular in cross-section, wherein said design tape is constituted by a couple of tape components arrayed side by side, that each of the tape components is provided at an edge portion of one of the selvages thereof with one of said round bar-like protrusions which is constructed by making use of hollow weave fabric, that said selvages of said couple of tape components are juxtaposed and connected with each other by making use of stitching thread which is applied to a boundary line between said protrusions and said selvages of tape components, and that the connected portion of said couple of tape components is unfolded back to a flattened state of the design tape where surfaces of said couple of tape components are made flush with each other.

According to the present invention, since the round bar-like protrusions each having a circular cross-section are respectively formed at an edge portion of the selvage of the tape component, the configuration in cross-section of the round bar-like protrusions can be retained substantially circular. Further, since a couple of tape components are once juxtaposed with the round bar-like protrusions being disposed face to face, and are connected with each other by making use of stitching thread which is applied to a boundary line between the protrusions and the selvages of tape components with the connected portion being ultimately folded back to a flattened state of the design tape, even if this couple of tape components are unfolded and made flush with each other, the circular configuration in cross-section of the protrusions cannot be substantially affected owing to the presence of the stitching thread connecting these tape components. As a result, it is now possible to obtain a design tape provided, along a central surface portion thereof, with a couple of round bar-like protrusions each of which is substantially circular in cross-section.

Further, there is also provided, as set forth in claim 2 of the present invention, a design tape provided with a round bar-like protrusion having a circular cross-section and extending along a central line of the surface of plain weave cloth, the round bar-like protrusion being constructed by making use of hollow weave fabric and substantially circular in cross-section, wherein said design tape is constituted by a couple of tape components arrayed side by side, that one of the tape components is provided at an edge portion of one of the selvages thereof with a round bar-like protrusion which is constructed by making use of hollow weave fabric, that these selvages of said couple of tape components are juxtaposed and connected with each other by making use of stitching thread which is applied to a boundary line between said protrusion and said selvages of tape components, and that the connected portion of said couple of tape components is unfolded back to a flattened state of the design tape where surfaces of said couple of tape components are made flush with each other.

According to the present invention, since a round bar-like protrusion having a circular cross-section is formed at an edge portion of the selvage of one of the tape components, the configuration in cross-section of the round bar-like protrusion can be retained substantially circular. Further, since a couple of tape components are once juxtaposed face to face, and are connected with each other by making use of stitching thread which is applied to a boundary line between the protrusion and the selvages of tape components with the connected portion being ultimately unfolded back to a flattened state of the design tape, even if this couple of tape components are unfolded and made flush with each other, the circular configuration in cross-section of the protrusion cannot be substantially affected due to the effect of the stitching thread to isolate the round bar-like protrusion from these tape components. As a result, it is now possible to retain the circular configuration in cross-section of the round bar-like protrusion of design tape.

DETAILED DESCRIPTION OF THE INVENTION

Next, one embodiment of the design tape according to the present invention will be explained with reference to the drawings.

Figure 1:
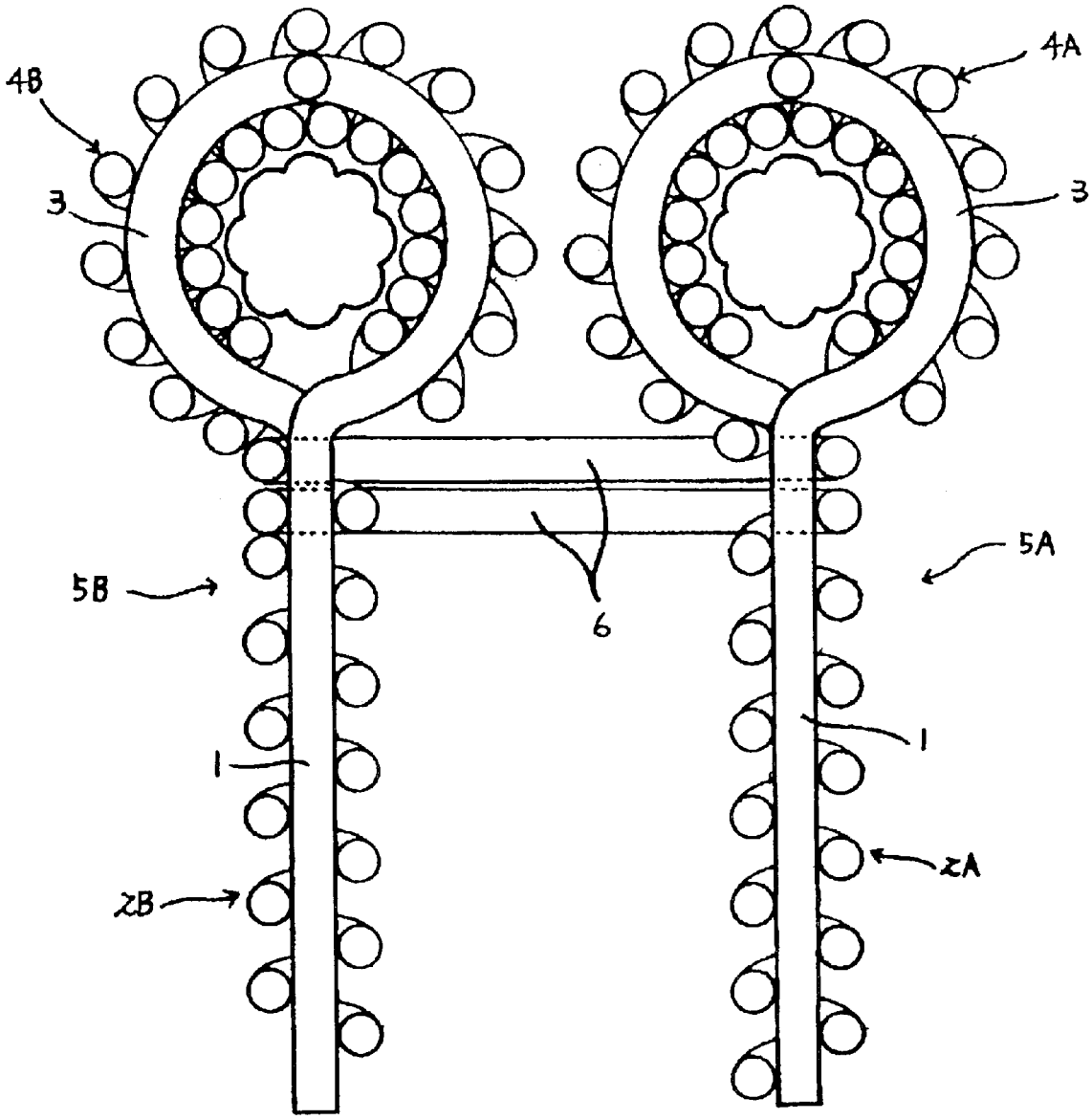
FIG. 1 is a schematic diagram illustrating the structure of a design tape according to one embodiment of the present invention, which is set forth in claim 1.
Figure 9:
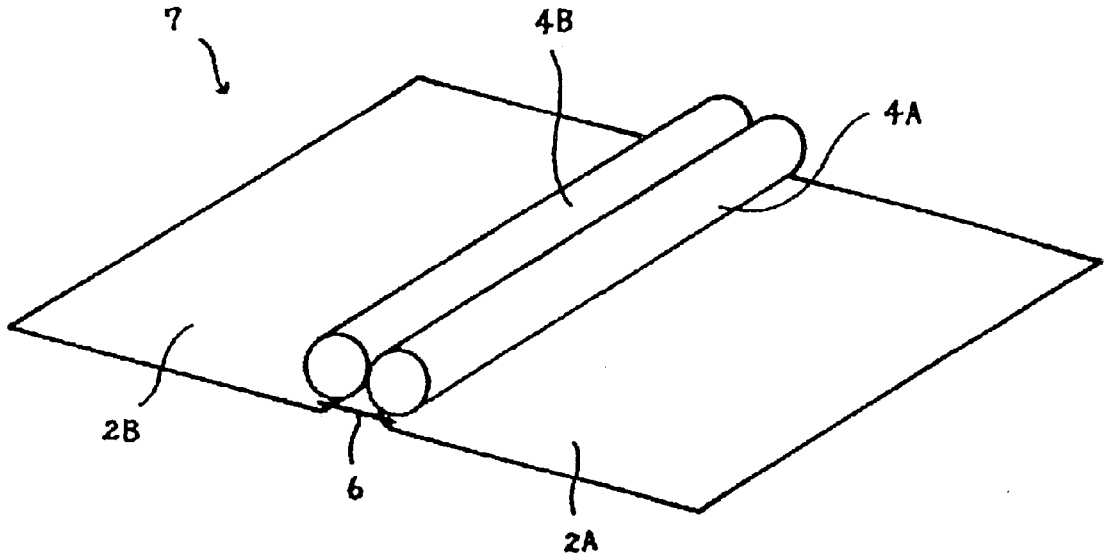
FIG. 9 is a perspective view illustrating the structure of the design tape shown in FIG. 1.

FIG. 1 is a schematic diagram illustrating the structure of a design tape according to one embodiment of the present invention, which is set forth in claim 1. FIG. 9 is a perspective view illustrating the structure of the design tape shown in FIG. 1. As shown in FIGS. 1 and 9, this design tape comprises a tape component 5A which is constituted by a base cloth 2A formed of plain weave fabric 1, and by a round bar-like protrusion 4A having a substantially circular cross-section which is formed at an edge portion of one of the selvages of the base cloth 2A by making use of hollow weave fabric 3, and another tape component 5B which is constituted, in the same manner as the aforementioned tape component 5A, by a base cloth 2B formed of plain weave fabric 1, and by a round bar-like protrusion 4B having a substantially circular cross-section which is formed at an edge portion of one of the selvages of the base cloth 2B by making use of hollow weave fabric 3. These tape components 5A and 5B are disposed in such a manner that the round bar-like protrusions 4A and 4B are disposed side by side, and the base cloths 2A and 2B are juxtaposed with each other.

These tape components 5A and 5B are connected with each other by applying stitching thread 6 to a boundary line between the protrusions 4A and 4B and the selvages of base cloths 2A and 2B (i.e. the neck portions of the protrusions 4A and 4B).

Figure 2:
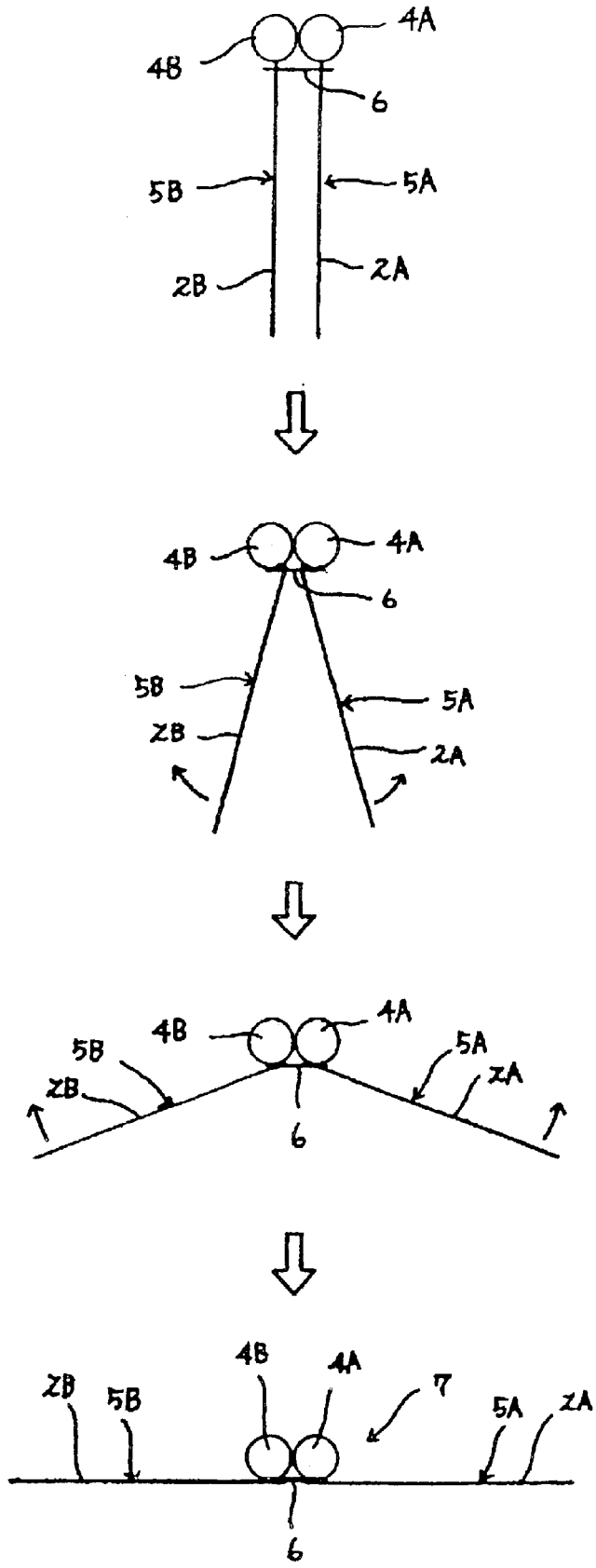
FIG. 2 is a schematic diagram illustrating, in stepwise, the manufacturing process of the design tape shown in FIG. 1.

FIG. 2 illustrates, in stepwise, the manufacturing process of the design tape shown in FIG. 1. Namely, after the tape components 5A and 5B are connected with each other by making use of the stitching thread 6 as shown in FIG. 1, the base cloths 2A and 2B of tape components 5A and 5B are gradually unfolded externally away from each other from this connected portion by an angle of 180 degrees, i.e. until this couple of base cloths 2A and 2B are completely flattened as a whole where surfaces of said couple of base cloths 2A and 2B are made flush with each other.

By unfolding these base cloths 2A and 2B in this manner, it is possible to obtain a design tape 7 having a couple of round bar-like protrusions 4A and 4B each having a circular cross-section and extending parallel with each other along a central line of the surface constituted by these base cloths 2A and 2B which have been formed into substantially a single sheet of cloth. In this case, since these two round bar-like protrusions 4A and 4B are substantially isolated from the base cloths 2A and 2B by the stitching threads 6, and furthermore, since these base cloths 2A and 2B are bent at these stitching threads 6, the circular configuration in cross-section of each of the protrusions 4A and 4B would not be substantially affected by the unfolding of these base cloths 2A and 2B.

This design tape can be manufactured as follows for instance. First of all, by making use of a weaving machine which is capable of concurrently weaving cloth bidirectionally, a round bar-like protrusion is formed by making use of hollow weave fabric at an edge portion of one of the selvages of each one of a couple of tape components. Then, by making use of a single or a plural number of stitching thread, these tape components are connected by combining a boundary portion between the round bar-like protrusion and the plain weave portion (or a neck portion of the round bar-like protrusion) of one of these tape components with a boundary portion between the round bar-like protrusion and the plain weave portion (or a neck portion of the round bar-like protrusion) of the other of these tape components, thereby obtaining an integrated design tape having attached thereon a couple of round bar-like protrusions as shown in FIG. 1.

Figure 3:
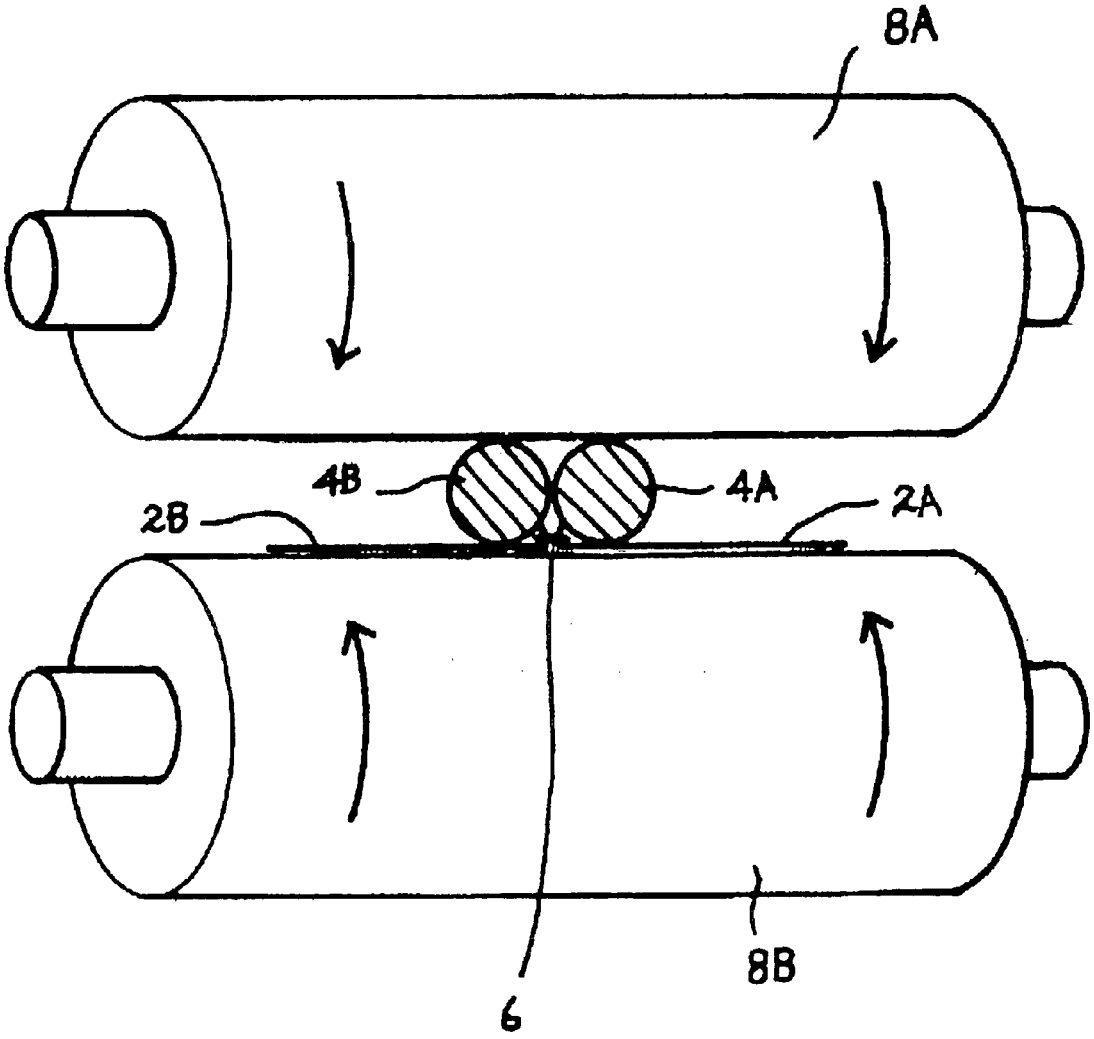
FIG. 3 is a schematic diagram specifically illustrating means for performing the unfolding of the tape components shown in FIG. 1.

After the integrated design tape has been fabricated in this manner, by making use of a pair of press rollers 8A and 8B of a finishing drier, these base cloths 2A and 2B are gradually spread and rolled to stabilize an unfolded state of these base cloths 2A and 2B, thus finishing the design tape where surfaces of said couple of base cloths 2A and 2B are made flush with each other (see FIG. 3).

Figure 4:
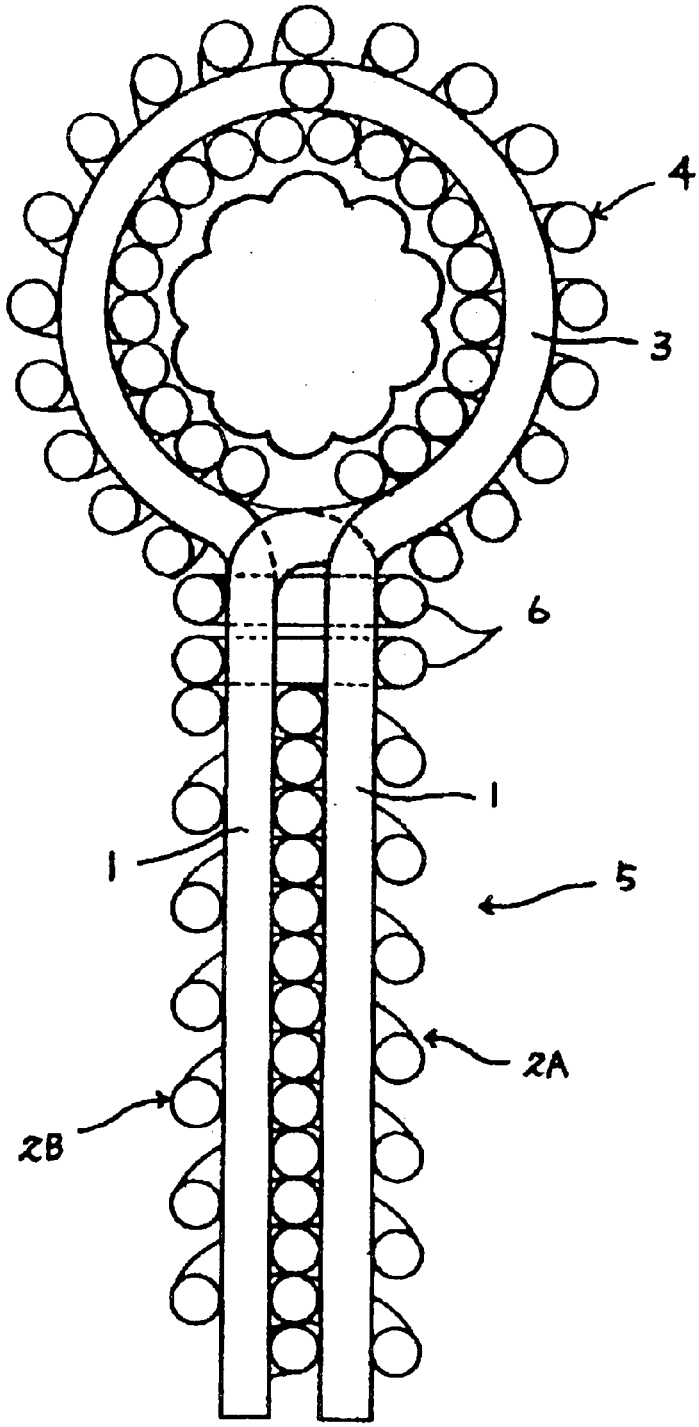
FIG. 4 is a schematic diagram illustrating the structure of a design tape according to one embodiment of the present invention, which is set forth in claim 2.
Figure 10:
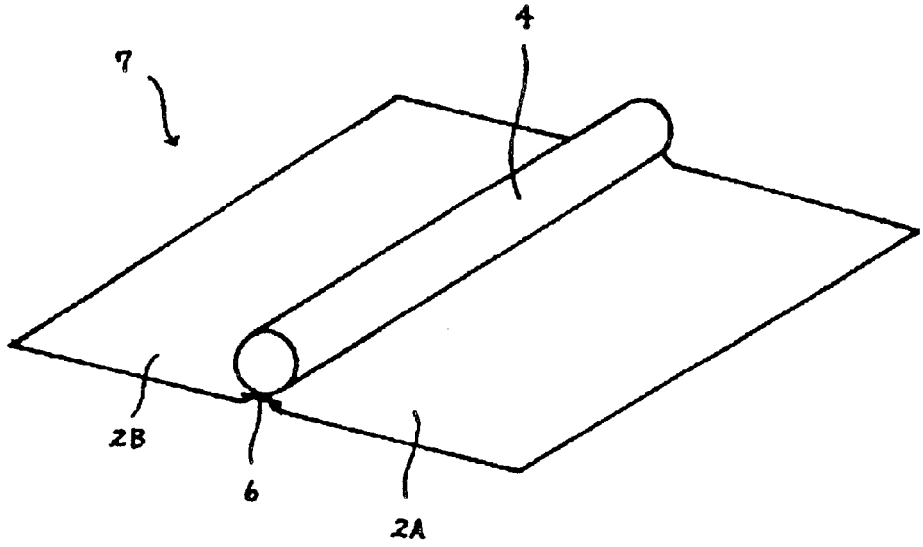
FIG. 10 is a perspective view illustrating the structure of the design tape shown in FIG. 4.

FIG. 4 is a schematic diagram illustrating the structure of a design tape according to another embodiment of the present invention, which is set forth in claim 2. FIG. 10 is a perspective view illustrating the structure of the design tape shown in FIG. 4. As shown in FIGS. 4 and 10, this design tape 5 comprises a couple of base cloths 2A and 2B, both of which being formed of plain weave fabric 1, wherein a round bar-like protrusion 4 having a substantially circular cross-section is formed at an edge portion of one of the selvages of one of the base cloths 2A and 2B by making use of hollow weave fabric 3. These base cloths 2A and 2B are then connected with each other by applying stitching threads 6 to a boundary line between the protrusion 4 and these base cloths 2A and 2B (i.e. the neck portion of the protrusion 4).

Figure 5:
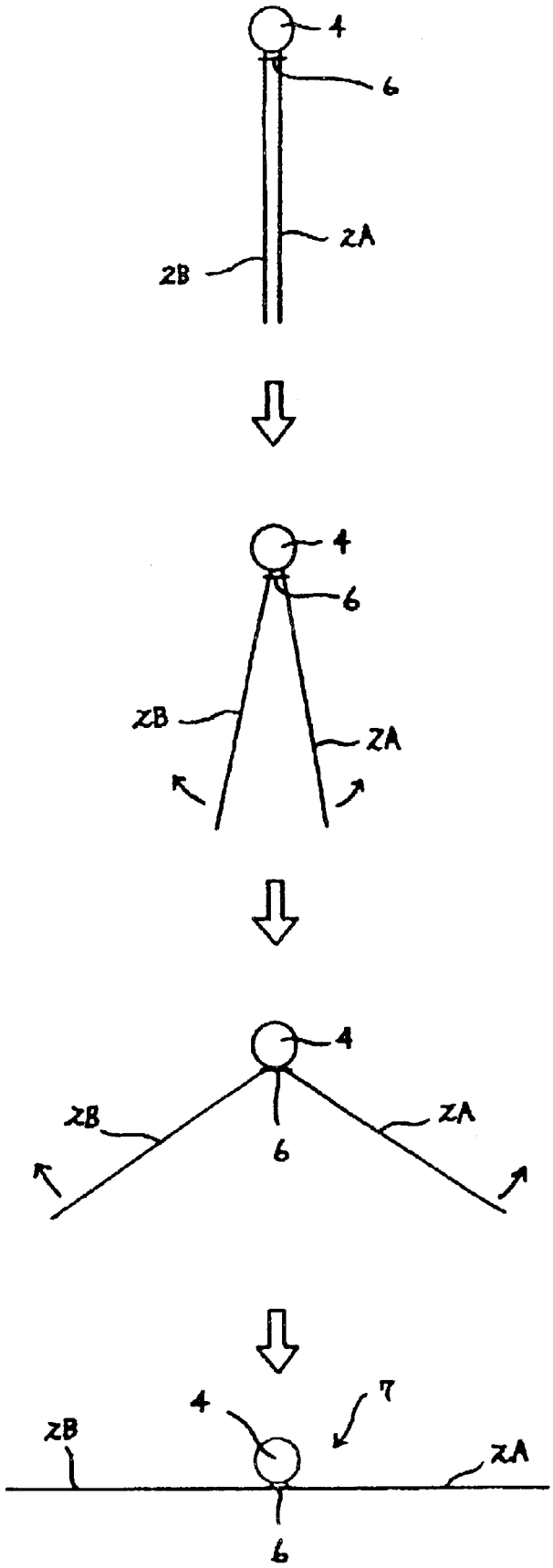
FIG. 5 is a schematic diagram illustrating, in stepwise, the manufacturing process of the design tape shown in FIG. 4.

FIG. 5 illustrates, in stepwise, the manufacturing process of the design tape 5 shown in FIG. 4. Namely, after these base cloths 2A and 2B are connected with each other by making use of the stitching thread 6, these base cloths 2A and 2B are gradually unfolded externally away from each other from this connected portion by an angle of 180 degrees, i.e. until these base cloths 2A and 2B are completely flattened as a whole where the surfaces of these base cloths 2A and 2B are made flush with each other.

By unfolding these base cloths 2A and 2B in this manner, it is possible to obtain a design tape 7 having a round bar-like protrusion 4 having a circular cross-section and extending along a central line of the surface constituted by these base cloths 2A and 2B which have been substantially formed into a single sheet of cloth. In this case, since this protrusion 4 is substantially isolated from the base cloths 2A and 2B by the stitching threads 6 in the same manner as in the case of the aforementioned double protrusion 4A and 4B which are provided along an intermediate line between the base cloths 2A and 2B, the circular configuration in cross-section of the protrusion 4 would not be substantially affected by the unfolding of these base cloths 2A and 2B.

Figure 6:
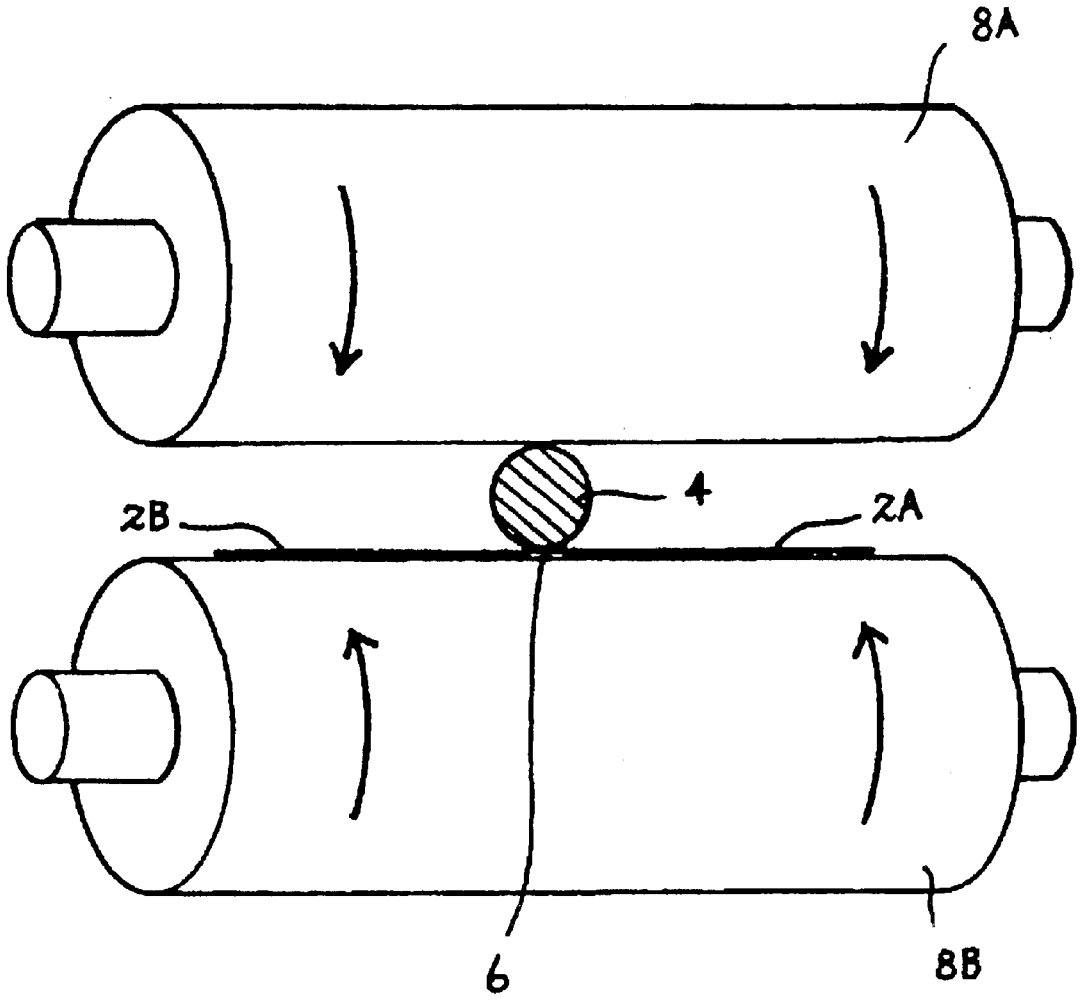
FIG. 6 is a schematic diagram specifically illustrating means for performing the unfolding of the tape components shown in FIG. 4.
Figure 7:
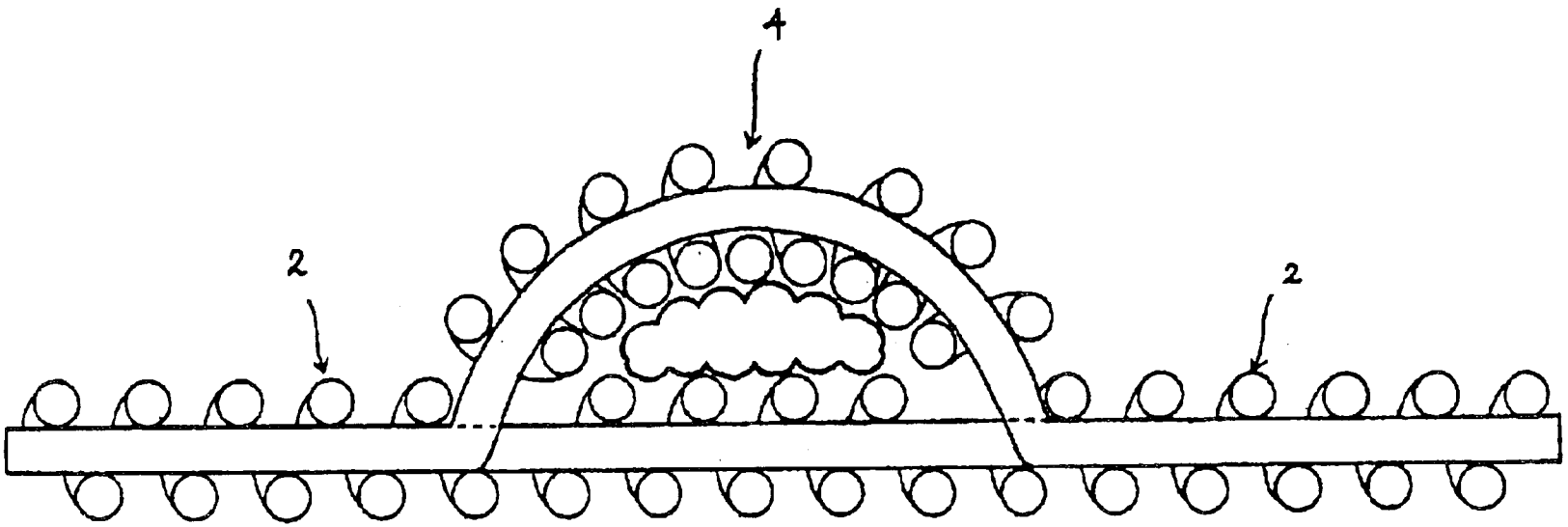
FIG. 7 is a schematic diagram illustrating the structure of a design tape according to the prior art.
Figure 8:
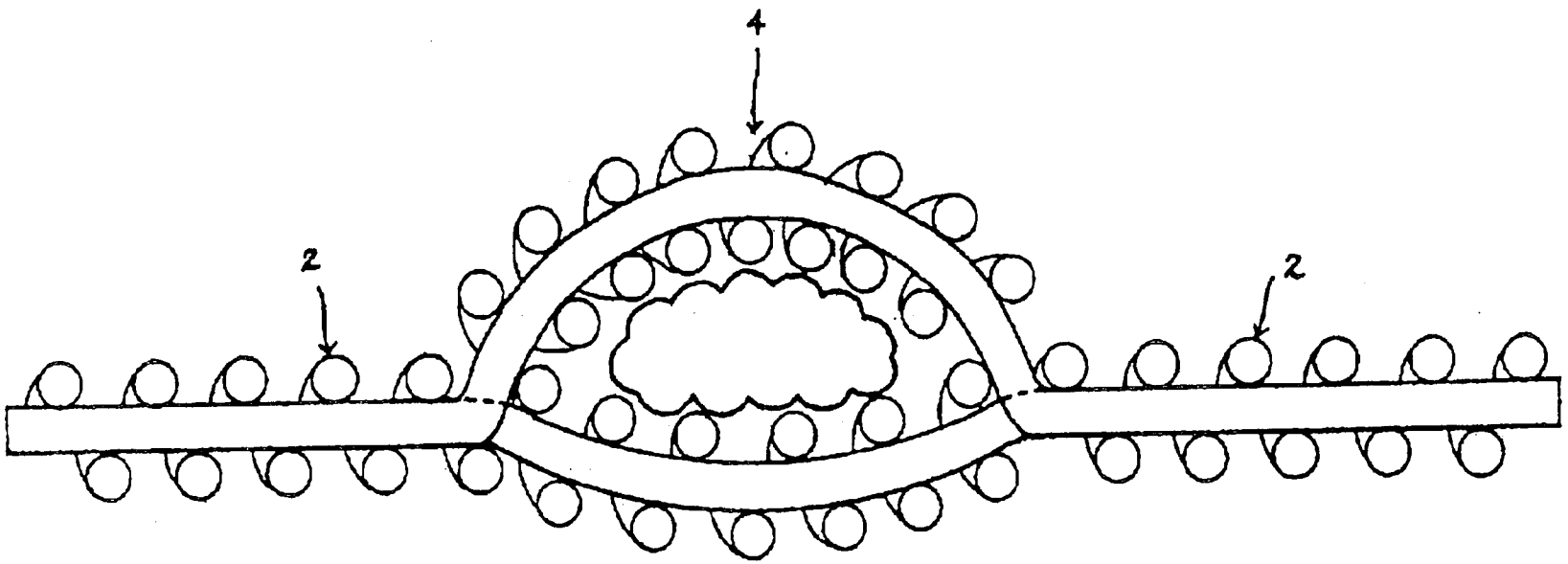
FIG. 8 is a schematic diagram illustrating the structure of another kind of design tape according to the prior art.

This design tape can be manufactured as follows for instance. First of all, by making use of a weaving machine which is capable of concurrently weaving cloth bidirectionally, a round bar-like protrusion is formed by making use of hollow weave fabric at an edge portion of one of the selvages of one of the base cloths 2A and 2B. Then, by making use of a single or a plural number of stitching thread, these base cloths 2A and 2B are connected by binding a boundary portion between the round bar-like protrusion and the plain weave portions (or a neck portion of the round bar-like protrusion) of these base cloths 2A and 2B, thereby obtaining an integrated design tape having attached thereon a round bar-like protrusion as shown in FIG. 4. After the integrated design tape has been fabricated in this manner, by making use of a pair of press rollers 8A and 8B of a finishing drier, these base cloths 2A and 2B are gradually spread and rolled, thus finishing the design tape (see FIG. 6).

As explained above, it is now possible according to the present invention to provide a design tape formed of plain weave cloth and provided with a round bar-like protrusion or a couple of round bar-like protrusions each having substantially a circular cross-section and extending along a central line of the surface thereof, thereby making it possible to considerably enhance the commercial value of the design tape.

While in the foregoing, illustrated embodiments of the present invention have been explained, it will be understood that the present invention is not limited to these embodiments, but the construction thereof can be varied without departing from the spirit and scope of the invention.

What is claimed is:

1. A design tape provided with a couple of round bar-shaped protrusions each having a circular cross-section and extending parallel with each other along a central line of a surface of plain weave cloth, each of the round bar-shaped protrusions being constructed by making use of hollow weave fabric and having a substantially circular cross-section, wherein said design tape is constituted by a couple of tape components arrayed side by side, that each of the tape components is provided at an edge portion of one of the selvages thereof with one of said round bar-shaped protrusions which is constructed by making use of hollow weave fabric, that said selvages of said couple of tape components are juxtaposed and connected with each other by making use of stitching thread which is applied to a boundary line between said protrusions and said selvages of tape components, and that the connected portion of said couple of tape components is unfolded back to a flattened state of the design tape where surfaces of said couple of tape components are made flush with each other.

* * * * *

UNITED STATES PATENT AND TRADEMARK OFFICE

CERTIFICATE OF CORRECTION

PATENT NO. : 6,884,490 B2
APPLICATION NO. : 10/414999
DATED : April 26, 2005
INVENTOR(S) : Shintaro Arai It is certified that error appears in the above-identified patent and that said Letters Patent is hereby corrected as shown below:

Col. 2, lines 21-22, remove “, as set forth in claim 2 of the present invention,”

Col. 4, line 34, remove “, which is set forth in claim 2”

Signed and Sealed this

Ninth Day of January, 2007

JON W. DUDAS
*Director of the United States Patent and Trademark Office*